US009130304B2

(12) United States Patent
Mehnert et al.

(10) Patent No.: US 9,130,304 B2
(45) Date of Patent: Sep. 8, 2015

(54) CIRCULAR CONNECTOR HAVING A SEALING ELEMENT WITH A CONICAL AND A CONCAVE SEALING SURFACES

(75) Inventors: Wolfgang Mehnert, Lindau (DE); Bernd Froese, Mülheim (DE)

(73) Assignee: ifm electronic gmbh, Essen (DE)

( * ) Notice: Subject to any disclaimer, the term of this patent is extended or adjusted under 35 U.S.C. 154(b) by 74 days.

(21) Appl. No.: 13/320,115

(22) PCT Filed: May 11, 2010

(86) PCT No.: PCT/EP2010/002873

§ 371 (c)(1), (2), (4) Date: Nov. 11, 2011

(87) PCT Pub. No.: WO2010/130400

PCT Pub. Date: Nov. 18, 2010

(65) Prior Publication Data

US 2012/0058659 A1 Mar. 8, 2012

(30) Foreign Application Priority Data

May 11, 2009 (DE) ..... 10 2009 003 016

(51) Int. Cl.
*H01R 13/52* (2006.01)

(52) U.S. Cl.
CPC ..... *H01R 13/5219* (2013.01); *H01R 13/5205* (2013.01)

(58) Field of Classification Search
USPC ..... 439/271–283, 519–524
See application file for complete search history.

(56) References Cited

U.S. PATENT DOCUMENTS

| | | | | | |
|---|---|---|---|---|---|
| 2,705,308 | A | * | 3/1955 | Forbes | 439/274 |
| 4,556,226 | A | * | 12/1985 | Ito | 439/273 |
| 4,611,872 | A | * | 9/1986 | Ito et al. | 439/277 |
| 4,917,620 | A | * | 4/1990 | Samejima et al. | 439/272 |
| 5,336,102 | A | * | 8/1994 | Cairns et al. | 439/272 |
| 5,451,717 | A | * | 9/1995 | Itou | 174/77 R |
| 5,667,296 | A | * | 9/1997 | Cheng et al. | 362/267 |
| 5,823,811 | A | * | 10/1998 | Blanchfield et al. | 439/274 |
| 7,753,705 | B2 | * | 7/2010 | Montena | 439/277 |
| 2003/0032321 | A1 | * | 2/2003 | Wertz et al. | 439/282 |
| 2013/0130530 | A1 | * | 5/2013 | Casses et al. | 439/271 |

FOREIGN PATENT DOCUMENTS

| | | | |
|---|---|---|---|
| DE | 10 2005 056 563 | B3 | 3/2007 |
| EP | 1 727 242 | A2 | 11/2006 |

* cited by examiner

*Primary Examiner* — Chandrika Prasad
(74) *Attorney, Agent, or Firm* — Roberts Mlotkowski Safran & Cole, P.C.; David S. Safran

(57) ABSTRACT

A specially designed sealing element (17) for a circular connector in which the sealing surface is subdivided into two areas, a first sealing section being designed to have a mainly radial sealing effect and a second sealing section being designed to have a mainly axial sealing effect. As a result, an effective sealing is achieved even in the case of counterparts having higher tolerances.

6 Claims, 4 Drawing Sheets

CIRCULAR CONNECTOR HAVING A SEALING ELEMENT WITH A CONICAL AND A CONCAVE SEALING SURFACES

BACKGROUND OF THE INVENTION

1. Field of the Invention

The invention relates to a circular connector for industrial applications having a socket part which has a handle body with a cylindrical contact carrier that can be inserted into a sleeve-shaped receiving region which is provided on a plug part made as a mating part.

2. Description of Related Art

German Patent DE 10 2005 056 563 B3 discloses a circular connector with a vibration resistance. Connectors without vibration resistance are also used in various branches of industry. They ordinarily are formed of an elastic handle body and a contact carrier with cable set. The cable set is positioned in the longitudinal direction and at 90° to the plug-in direction. The handle body encompasses both the contact carrier and also the cable set in sections.

Designs are also known in which the user can connect the cable itself to a plug-in system. Here, the handle body is made as a housing with internal contact terminals.

A union nut with an internal thread is designed for connection to a corresponding mating part which can be provided, for example, on a sensor of industrial automation technology. Two versions of the connector are possible, male (plug) and female (socket).

In the operating state, the sensors are securely connected to a control/evaluation unit via the respective cable set. Often, in the control/evaluation units, not only are the sensor signals evaluated, but the voltage supply of the sensors is also made available from there.

Often, these connectors are used in very rough industrial environments. One area of application of these connectors is the food domain where strict hygiene regulations apply to the systems. Generally acid-containing or basic detergent/disinfection agents are used to clean them.

Another area of application is the production/tool domain (non-food) where the systems must meet other requirements. For connectors in this domain, especially coolant or lubricant resistance is of great importance.

In both applications (food/non-food) high pressure/steam jet cleaning methods can also be used.

Altogether, the penetration of liquids into the inner region of an installed connector can lead to corrosion on conductive components within the connector (for example, on the contact carrier).

A failure of a connector, for example, due to corrosion, depending on the application, can lead to shutdown of the entire system under certain circumstances, and thus, can cause major costs.

For small connectors, i.e., ≤M8, there is an industrial standard DIN EN 61076-2-104 which for M8 circular connectors among others specifies the dimensioning of the plug parts with the corresponding tolerances.

O-rings are often used for sealing in these connectors, which are smaller than the M12 plugs. However, since there is no defined support or stop surface for the plugs, the O-ring can be pinched or pushed out of its intended position when the screwed connection is established because there must be a certain axial play between the connector and the mating part. In both cases the sealing action can be adversely affected.

The O-rings are pinched to an intensified degree when deviations from the standard occur in the production of the connectors or their mating parts, as cannot be precluded in manufacturers around the world.

Nor can it be precluded that the O-ring will stick on the mating part and therefore will be lost unnoticed by the user when the plug and socket connection is broken on the actual connector. When another plug and socket connection is established, the sealing element is then missing and liquid can very easily travel into the inner region of the connector. Altogether, reliable sealing in connectors cannot be ensured via an O-ring as the sealing element.

SUMMARY OF THE INVENTION

The object of the invention is, therefore, to devise a circular connector which does not have the aforementioned disadvantages and which enables especially permanent sealing of a plug and socket connection which is stable over the long term.

This object is achieved by the provision of a sealing element on the contact carrier which surrounds the contact carrier and which in the direction of the forward edge of the contact carrier has a sealing surface which is divided into a first sealing section and a second sealing section, the first sealing section producing a predominantly radial sealing action and the second sealing section producing a predominantly axial sealing action.

The significant idea of the invention comprises providing a specially shaped sealing element in a circular connector in accordance with the invention, the sealing surface of the element being divided into two regions, a first sealing section being designed mainly for a radial sealing action and a second sealing section being designed for a predominantly axial sealing action.

The first sealing section equalizes radial displacements when the circular connector is seated because this sealing section assumes more or less a centering function.

If the centering function of the first sealing section is not adequate or is ineffective because there are larger deviations from the standard on the mating part (male), the second sealing section can even bridge, and thus, axially seal greater distances.

The invention is explained in detail below with reference to the exemplary embodiment shown in the drawings.

DETAILED DESCRIPTION OF THE INVENTION

Figure 1:
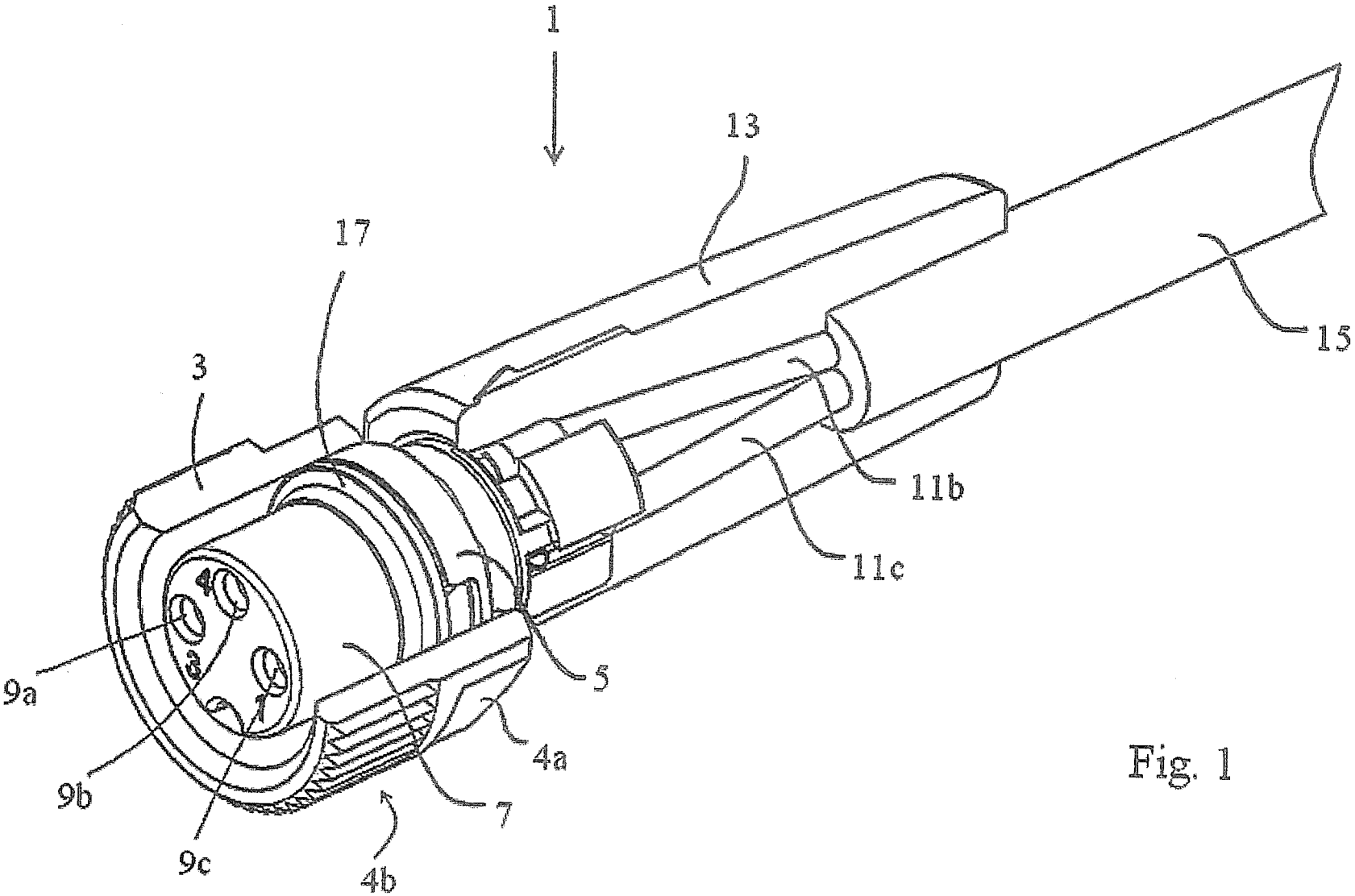
FIG. 1 is a partially cutaway, perspective plan view of a circular connector.

FIG. 1 shows the socket part of a M8 circular connector 1 (female). On its forward first end, the circular connector 1 has a union nut 3 with a ISO M8 size metric internal thread of metal (preferably high-grade steel, brass, or a zinc die casting) and key surfaces 4*a* for a hexagonal key and knurling 4*b* for manual operation. The union nut 3 is rotationally held by a corresponding metallic stop sleeve 5 which encompasses a cylindrical contact carrier 7. In the contact carrier 7, there are several contact elements 9*a*, 9*b*, 9*c* which are made as sockets and which are connected to individual cables 11*b*, 11*c* of a cable set 11. The contact carrier 7 and the cable set 11 are at least partially surrounded by an elastic handle body 13. The handle body 13 adjoins the union nut 3 on the front end of the circular connector in the region of the stop sleeve 5 and positively surrounds the cable jacket 15 of the cable set 11 on the back end of the circular connector 1.

The handle body 13 is made as an injection molded part. By using an adhesive in the overlapping region of the cable set 11 with the handle body 13 and on the coating region of the contact carrier 7, a permanent flexible connection is achieved between the handle body 13 and the cable set 11; this is very advantageous with respect to the sealing action, especially against moisture.

The adhesive is applied during production to the cable jacket 15, the individual cables 11 and the contact carrier 7 in the overlapping region.

The circular connector 1 is connected to a plug mating part (not shown) and which has appropriately made contact elements.

This mating part can be provided, for example, on a sensor, such as inductive proximity switches M8 ifm IE5349 or JAC200 which are approved for a wet application. In the operating state, the sensor is then connected to a control/evaluation unit via the cable set 15. The reliable transmission of sensor data to the control/evaluation unit is of great importance for the application.

There is an elastic sealing element 17 made of a fluoroelastomer (FPM/FKM; e.g., VITON®) for sealing of the contact carrier 7, mainly against liquids.

Figure 2:
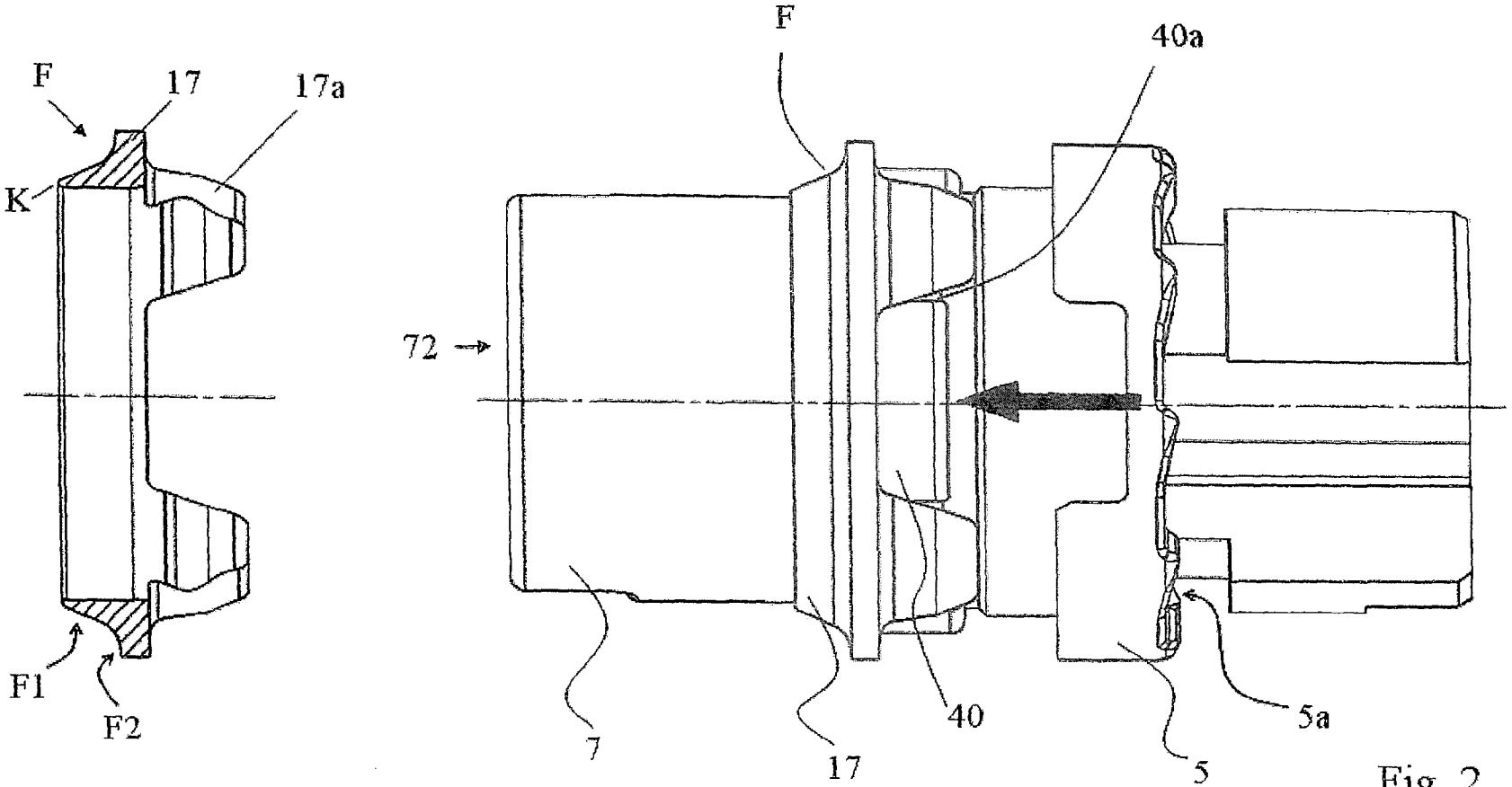
FIG. 2 is an enlarged side elevational view of a contact carrier with a sealing element in accordance with the invention according to FIG. 1.

FIG. 2 shows an enlarged view of the contact carrier 7 with a sealing element 17 in accordance with the invention according to FIG. 1 in a side view, once in the seated state (right side) and once as a separate part (left side). For the sake of clarity, the handle body 13 and the union nuts 3 are not shown. The sealing element 17 has several projections 17*a* which project into corresponding openings which are provided on a collar 40 of the contact carrier 7 and lock on a bead 8 as can be better recognized in FIG. 3.

In this position, the sealing element 17 is captively fixed by pushing on the stop sleeve 5 (in the direction of the arrow). Altogether, the sealing element 17 is therefore held securely on the contact carrier 7.

The collar 40 and the slightly projecting tips of the projections 17*a* are used as a stop for the stop sleeve 5, the projecting length acting elastically on the stop sleeve 5 due to the elasticity of the entire sealing element 17, and thus, also of the projections 17*a*. The stop sleeve 5 is made as a resistance element for vibration resistance as known from German Patent DE 10 2005 056 563 B3, and therefore, has several sloped surfaces 5*a* (FIG. 2) which act with corresponding mating surfaces provided on the union nut 3 such that the union nut 3 can be relatively easily screwed on, but can be detached only with corresponding difficulty.

The spring action of the projections 17*a* supports the action of vibration resistance when the union nut 3 is screwed onto the mating part of the connector.

The sealing element 17 (which is shown separately in a sectional view in FIG. 2) has a sealing surface F that is divided into two differently curved sections F1 (cone-shaped) and F2 (concave). The section F1 is more conical and the section F2 more spherical.

In the installed state, the sealing surface extends in a direction toward the front edge 72 of the contact carrier 7.

The operation of the sealing element 17 in accordance with the invention is explained below. FIG. 3*a* shows a sectional view of a contact carrier 7 with the sealing element 17 in accordance with the invention in the installed state with the indicated standard mating part (male/plug). Here, the contact carrier 7 of the socket part is already inserted into the sleeve-shaped receiving region of the plug part. The relative position of the sealing element 17 and of the stop sleeve 5 can be better recognized here. The stop sleeve 5 lies on the ends of the projections 17*a* and does not yet touch the interrupted collar 40 which is not visible in the illustrated section.

When the circular connector 1 is slipped onto a mating part 50 which has been produced according to EN DIN 61076-2-101 standard, the front edge K of the sealing element 17 slides under the corresponding edge K' on the receiving opening of the plug mating part 50. In doing so, the contact carrier 7 is automatically centered in the sleeve-shaped receiving region 52 of the plug mating part 50. According to the standard, an axial gap remains between the front edge 72 of the contact carrier 7 and the base surface 54 of the receiving opening of the plug mating part. The sealing action of the sealing element 17 takes place essentially by the conical sealing section F1, the action of the force on the sealing surfaces F taking place predominantly in the radial direction.

Because the stop sleeve 5 overlaps the projections 17*a* of sealing element 17 in the region of the bead 8, at the same time, it is used as a safeguard for the sealing element 17 against unintentional loss. Conventional O-rings as sealing elements are easily withdrawn at the same time when the plug and socket connection is broken; this is often not noticed by the user. Unintentional detachment of the sealing element 17 is thus precluded.

Figure 3B:
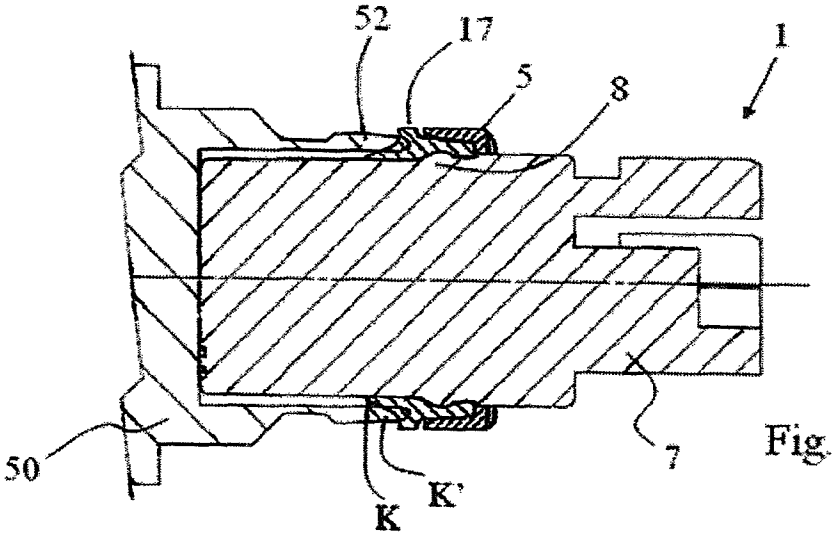
FIG. 3*b* is a longitudinal sectional view of a sealing element in the installed state with a mating part which deviates from the standard.
Figure 3A:
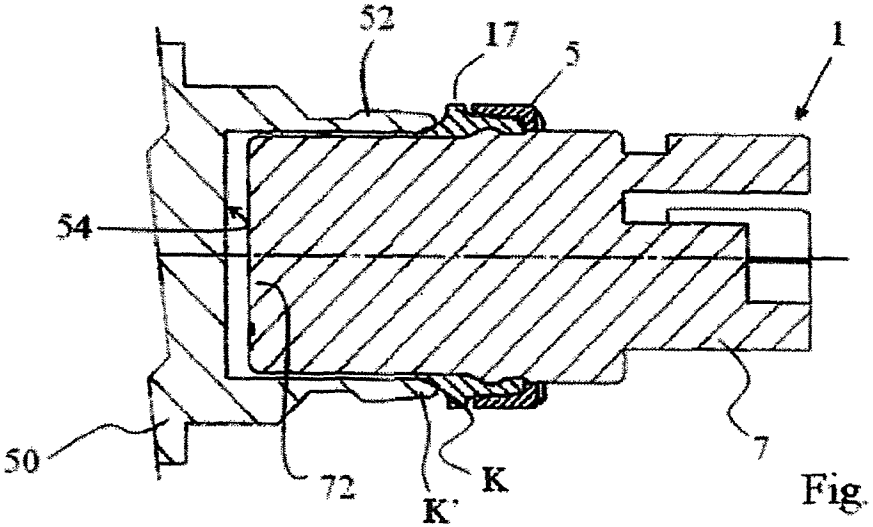
FIG. 3*a* is a longitudinal sectional view of a contact carrier with the sealing element in accordance with the invention in the installed state with a standard mating part.

FIG. 3*b* clearly shows that, at this point, the sealing action is assumed by the concavely shaped sealing section F2. The action of the force on the sealing surfaces is thus more axial. At the same time the front edge of the contact carrier 7 and the base surface 54 abut one another. In both cases, however, there is an adequate sealing action to prevent penetration of liquids or dust.

FIG. 3*b* clearly shows that, at this point, the sealing action is assumed by the convexly shaped sealing section F2. The action of the force on the sealing surfaces is thus more axial. At the same time the front edge of the contact carrier 7 and the base surface 54 abut one another. In both cases, however, there is an adequate sealing action to prevent penetration of liquids or dust.

Figure 4:
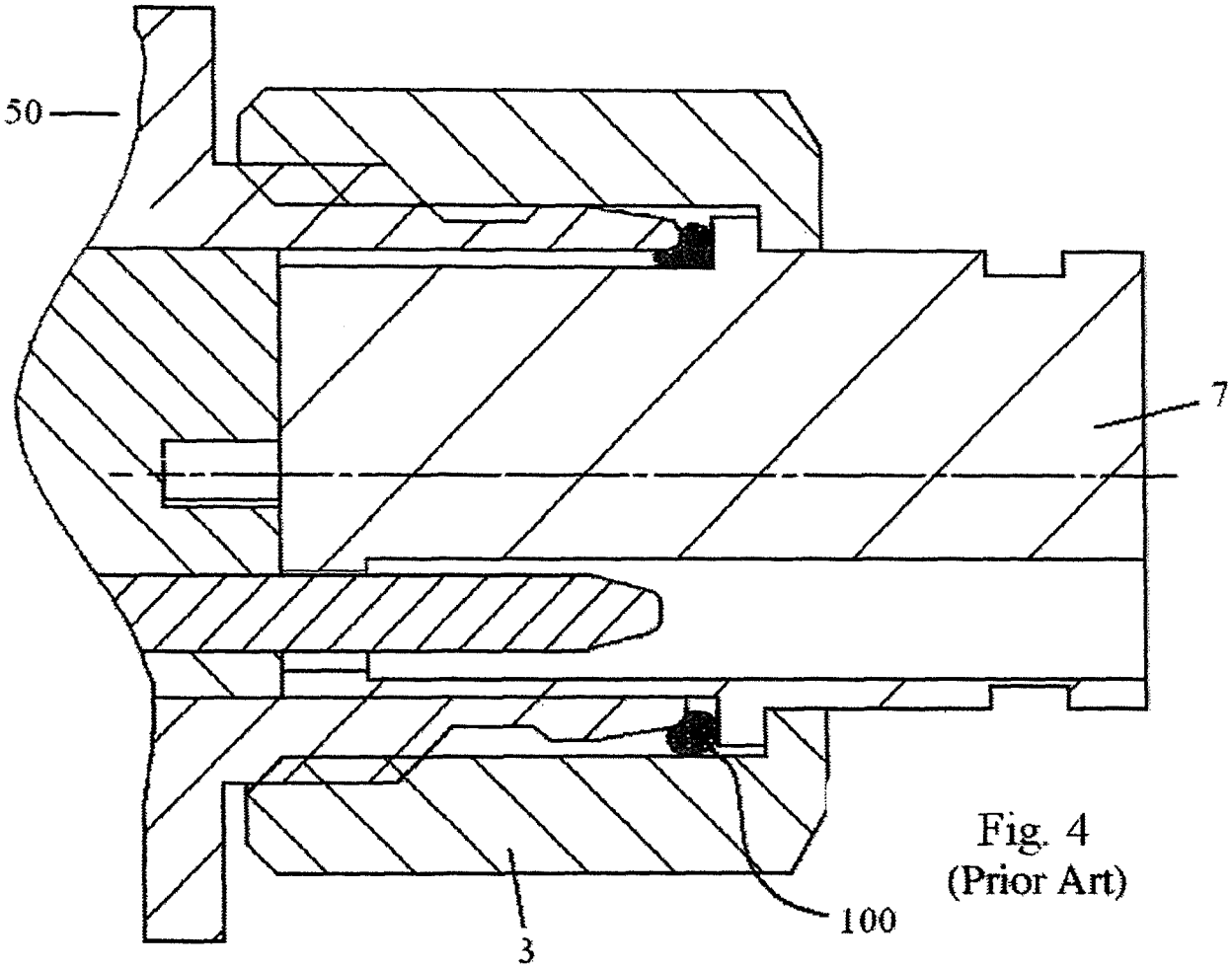
Fig. 4 (Prior Art)
FIG. 4 shows a section of a contact carrier with a conventional sealing element in the installed state with a mating part.

For comparison, FIG. 4 shows a plug and socket connection with a conventional socket part with an O-ring 100 as sealing element. In particular, for deviations from the standard, an axial offset between the two parts socket/sleeve of the plug and socket connection can occur; this inevitably results in pinching of the O-ring 100. In this connection, damage to the O-ring cannot be precluded. This damage generally cannot be detected with the naked eye so that a user does not recognize this fault at all in a visual inspection. The effects of this damage often become noticeable only with a major time delay.

Since the O-ring 100 is slipped only onto the contact carrier, it can be easily lost, for example, when it sticks on the plug part.

With the circular connector 1 in accordance with the invention, for industrial applications, there is obtained reliable sealing of a plug-and-socket connection even when the plug and socket connection is frequently broken. This also applies especially when there are deviations from the standard on the mating part of the circular connector. The sealing element 17 is reliably fixed on the contact carrier 7 by locking, and therefore, cannot be unintentionally lost.

The design in accordance with the invention can be used in all existing M8 connectors/devices.

What is claimed is:

1. A circular connector for industrial applications, comprising:

a socket part which has a handle body with a cylindrical contact carrier which is configured so as to be insertable into a sleeve-shaped receiving region which is provided on a mating plug part, a separate sealing element on the contact carrier, which surrounds the contact carrier and which has a sealing surface extending in a direction toward a forward edge of the contact carrier, the sealing surface being divided into a first sealing section and a second sealing section, the first and second sealing sections being contiguous on a single side of the sealing element, the first sealing section having a conical shape so as to produce a predominantly radial sealing action and the second sealing section having a concave shape so as to produce a predominantly axial sealing action to enable the sealing surface to be adaptable to mating plug parts of different inside diameters, wherein the sealing element is spaced from the handle body at an opposite side of the cylindrical contact carrier therefrom.

2. The circular connector as claimed in claim 1, wherein the sealing element is configured for being locked onto the contact carrier.

3. The circular connector as claimed in claim 1, wherein the circular connector is an M8 circular connector.

4. The circular connector as claimed in claim 1, wherein the sealing element has projections on a side opposite the sealing surface, the projections being elastically adjoined by a stop sleeve that is adapted to function as a vibration resistance element.

5. The circular connector as claimed in claim 1, wherein the second sealing section has a convex shape.

6. The circular connector as claimed in claim 1, wherein the sealing element has projections on a side opposite the sealing surface, the projections being elastically adjoined by a stop sleeve that is adapted to function as a vibration resistance element.

* * * * *